US011698239B2

(12) United States Patent
Puha et al.

(10) Patent No.: US 11,698,239 B2
(45) Date of Patent: Jul. 11, 2023

(54) MUZZLE DEVICE FOR A FIREARM

(71) Applicant: Eight Holdings, LLC, Coeur D-Alene, ID (US)

(72) Inventors: Teodor Puha, Coeur D-Alene, ID (US); Cody Cohen, Coeur D-Alene, ID (US)

(73) Assignee: EIGHT HOLDINGS LLC, Coeur d'Alene, ID (US)

( * ) Notice: Subject to any disclaimer, the term of this patent is extended or adjusted under 35 U.S.C. 154(b) by 0 days.

(21) Appl. No.: 17/568,602

(22) Filed: Jan. 4, 2022

(65) Prior Publication Data

US 2022/0214129 A1 Jul. 7, 2022

Related U.S. Application Data

(60) Provisional application No. 63/133,693, filed on Jan. 4, 2021.

(51) Int. Cl.

| | |
|---|---|
| ***F41A 21/32*** | (2006.01) |
| ***F41A 21/36*** | (2006.01) |
| ***F41A 21/28*** | (2006.01) |
| ***F41A 21/30*** | (2006.01) |

(52) U.S. Cl.

CPC ..... *F41A 21/325* (2013.01); *F41A 21/28* (2013.01); *F41A 21/30* (2013.01); *F41A 21/36* (2013.01)

(58) Field of Classification Search

CPC ..... F41A 21/32; F41A 21/325; F41C 23/16

See application file for complete search history.

(56) References Cited

U.S. PATENT DOCUMENTS

| | | | | |
|---|---|---|---|---|
| 8,667,726 | B1 * | 3/2014 | Huff | F41G 11/003 42/71.01 |
| 9,658,010 | B1 * | 5/2017 | Oglesby | F41C 23/16 |
| 9,891,017 | B1 * | 2/2018 | Lee | F41A 21/325 |
| 10,371,476 | B1 * | 8/2019 | Oglesby | F41A 21/30 |
| 11,022,395 | B1 * | 6/2021 | Lee | F41A 21/30 |
| 11,150,045 | B1 * | 10/2021 | Oglesby | F41A 21/30 |
| 11,262,150 | B1 * | 3/2022 | VanFossan | F41A 21/36 |
| 2010/0186276 | A1 * | 7/2010 | Herring | F41A 21/48 42/6 |
| 2015/0101232 | A1 * | 4/2015 | Schoenlau | F41C 23/16 42/90 |
| 2017/0191779 | A1 * | 7/2017 | Myers | F41A 21/48 |
| 2018/0051951 | A1 * | 2/2018 | McNitt | F41C 27/16 |
| 2018/0142874 | A1 * | 5/2018 | Pinilla | F41C 23/22 |
| 2019/0072354 | A1 * | 3/2019 | Lee | F41A 21/325 |
| 2019/0120584 | A1 * | 4/2019 | Bender | F41A 21/30 |
| 2020/0232734 | A1 * | 7/2020 | Herring | F41A 19/44 |
| 2020/0256637 | A1 * | 8/2020 | Leslie | F41C 23/16 |
| 2021/0199405 | A1 * | 7/2021 | Becklin | F41A 3/66 |

(Continued)

*Primary Examiner* — Derrick R Morgan

(74) *Attorney, Agent, or Firm* — Eric B. Fugett; Mark A. Pitchford; Pitchford Fugett, PLLC

(57) ABSTRACT

A firearm includes a muzzle device. The muzzle device includes a muzzle adapter and a muzzle attachment. The muzzle attachment suppresses noise and/or redirects gases and recoil. The firearm utilizes recoil operation to cycle such that the barrel reciprocates inside a handguard of the firearm during cycling. The muzzle adapter is attached to the handguard and receives the barrel therein. The muzzle attachment is secured to the muzzle adapter such that the muzzle of the barrel remains longitudinally in the muzzle adapter during discharge and cycling of the firearm.

20 Claims, 6 Drawing Sheets

(56) References Cited

U.S. PATENT DOCUMENTS

| | | | | |
|---|---|---|---|---|
| 2021/0372723 | A1* | 12/2021 | Kellgren | F41A 21/30 |
| 2021/0381794 | A1* | 12/2021 | Lawson | F41A 21/30 |
| 2022/0170712 | A1* | 6/2022 | Engelbreit | F41A 21/32 |
| 2022/0214129 | A1* | 7/2022 | Puha | F41A 21/36 |
| 2022/0244010 | A1* | 8/2022 | Puha | F41A 5/12 |

* cited by examiner

MUZZLE DEVICE FOR A FIREARM

CROSS-REFERENCES TO RELATED APPLICATIONS

This application claims priority to and hereby incorporates by reference in its entirety U.S. Provisional Patent Application No. 63/133,693 entitled "MUZZLE DEVICE FOR A FIREARM" filed on Jan. 4, 2020.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to firearms. More specifically, the present invention relates to muzzle devices for firearms.

A muzzle device is a device that is typically fixed to the muzzle of the barrel of a firearm in order to modify the functionality and/or operational capabilities of the firearm. Muzzle devices have been designed to reduce recoil, hide flash, adjust choke, act as an offensive weapon, and/or breach doors. Muzzle devices for breaching doors (also known as "breachers," "breacher tips," and "door breachers") are commonly fixed (i.e., welded, soldered, or threaded) to the muzzle of shotgun barrels. They typically include aggressive teeth at the forward end designed to bite into the door and hold the muzzle in position over the door hinges while the shooter presses the muzzle device teeth against the door and pulls the trigger.

However, currently available muzzle devices are designed for use only on firearms with static (i.e., non-reciprocating) barrels. These muzzle devices are not safe to use on firearms with handguards and reciprocating barrels, such as AR-platform firearms with recoil-based operating systems, because the muzzle device can contact the handguard surrounding the barrel when the barrel reciprocates rearward inside the handguard during operation and cycling of the firearm. This can prevent the firearm from cycling, damaging the barrel, handguard, and muzzle device, and it may also injure the shooter or others.

One type of firearm operating system that makes use of a reciprocating barrel is a short recoil operating mechanism. Numerous embodiments of short recoil operating mechanisms are known. In general, upon firing, the barrel and bolt of a short recoil operating mechanism recoil together a short distance before the bolt unlocks from the barrel and they separate. The barrel stops relatively quickly while the bolt continues rearward, extracting a casing from the chamber and compressing the recoil spring. The bolt then moves forward again and feeds a new cartridge (i.e., shell) into the chamber. During the last portion of its forward travel, the bolt locks back into the barrel and pushes the barrel forward back into battery. This type of short recoil operating mechanism is exemplified by the "GEN-12" AR-platform 12-gauge shotgun firearm manufactured by Genesis Arms, LLC and disclosed in U.S. Pat. No. 10,605,553.

BRIEF SUMMARY OF THE INVENTION

Aspects of the present invention provide a muzzle device for firearms with short recoil operating mechanisms and handguards (e.g., AR-platform firearms). The muzzle device does not contact the handguard during cycling of the firearm and does not require the reciprocating barrel to carry the weight of the muzzle device during cycling of the firearm.

In one aspect, a muzzle adapter for a firearm includes a base portion, and an extension portion. The base portion is configured to attach to a handguard of the firearm and extend radially inward toward a longitudinal axis and a barrel of the firearm. The base portion is configured to receive the barrel of the firearm therein. The extension portion is attached to the base portion and supported by the base portion. The extension portion is configured to receive the muzzle attachment in the base portion is closer to about stock of the farm than the extension portion when the muzzle adapters properly attached to the handguard firearm such that the extension portion extends forward from the base portion and the base portion is rearward of the extension portion. The butt stock defines the rear end of the firearm.

In another aspect, a firearm includes a barrel, handguard, and a muzzle adapter. The barrel extends along a longitudinal axis and includes a bore therein. The handguard generally surrounds the barrel along a portion of the barrel. The muzzle adapter includes a base portion and an extension portion. The base portion is configured to attach to the handguard and extend radially inward toward the longitudinal axis and barrel of the firearm from the handguard. The base portion is configured to receive the barrel of the firearm therein. The extension portion is attached to the base portion and supported by the base portion. The extension portion is configured to receive a muzzle attachment and the base portion is closer to about stock of the firearm than the extension portion when the muzzle adapter is properly attached the handguard of the firearm such that the extension portion extends forward from the base portion and the base portion is rearward of the extension portion.

BRIEF DESCRIPTION OF THE SEVERAL VIEWS OF THE DRAWINGS

Reference will now be made in detail to optional embodiments of the invention, examples of which are illustrated in accompanying drawings. Whenever possible, the same reference numbers are used in the drawing and in the description referring to the same or like parts.

DETAILED DESCRIPTION OF THE INVENTION

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

As described herein, an upright position is considered to be the position of apparatus components while in proper operation or in a natural resting position as described herein. The upright position of a firearm is in a level firing position as shown in FIGS. 4, 6, 7, 8, and 10. A muzzle adapter is properly installed in a handguard when secured into the handguard such that its bore aligns with a longitudinal axis of the bore of the barrel of the firearm including the handguard. Vertical, horizontal, above, below, side, top, bottom and other orientation terms are described with respect to this upright position during operation unless otherwise specified. The term "when" is used to specify orientation for relative positions of components, not as a temporal limitation of the claims or apparatus described and claimed herein unless otherwise specified. The terms "above", "below", "over", and "under" mean "having an elevation or vertical height greater or lesser than" and are not intended to imply that one object or component is directly over or under another object or component.

The phrase "in one embodiment," as used herein does not necessarily refer to the same embodiment, although it may. Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without operator input or prompting, whether these features, elements and/or states are included or are to be performed in any particular embodiment.

Figure 1:
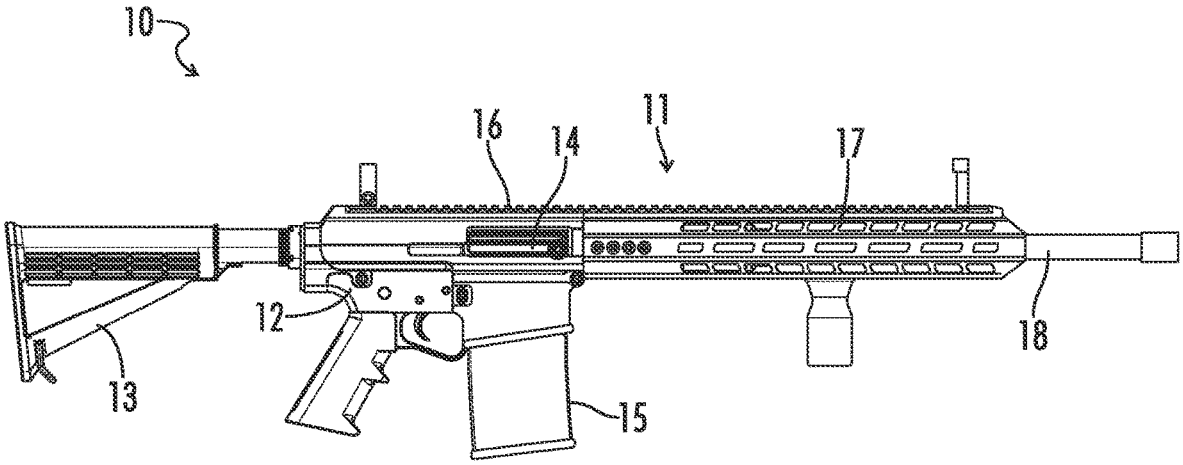
FIG. 1 (PRIOR ART)
FIG. 1 is a side perspective view of an embodiment of a prior art AR-platform shotgun firearm with a short recoil operating mechanism.
Figure 2:
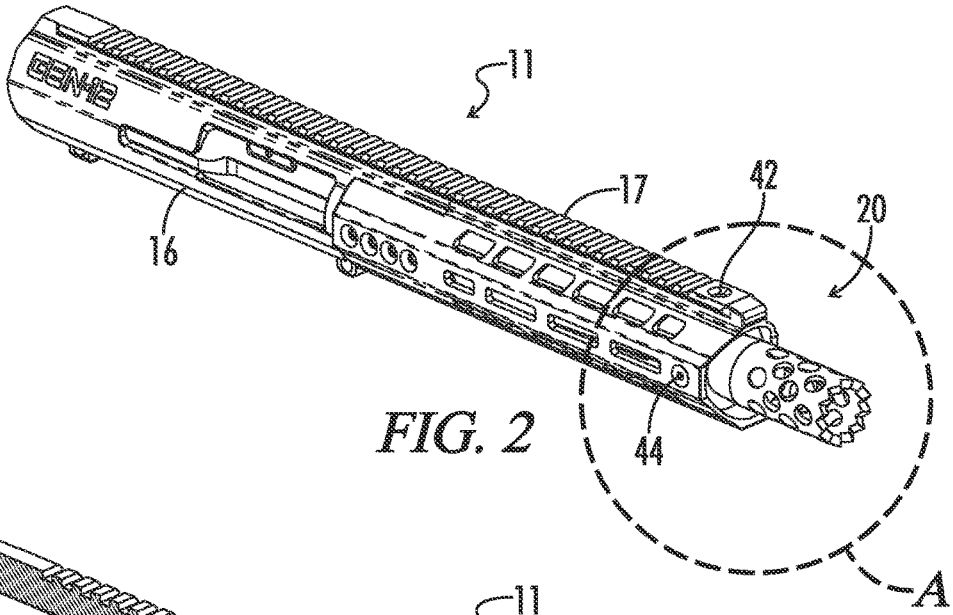
FIG. 2 is a front isometric view of an upper receiver assembly of an AR-platform shotgun firearm with a short recoil operating mechanism showing one embodiment of a muzzle device of the present invention detachably secured inside the forward end of the handguard. Among other components and accessories, a lower receiver, bolt, and buttstock of the firearm are omitted for clarity.
Figure 3:
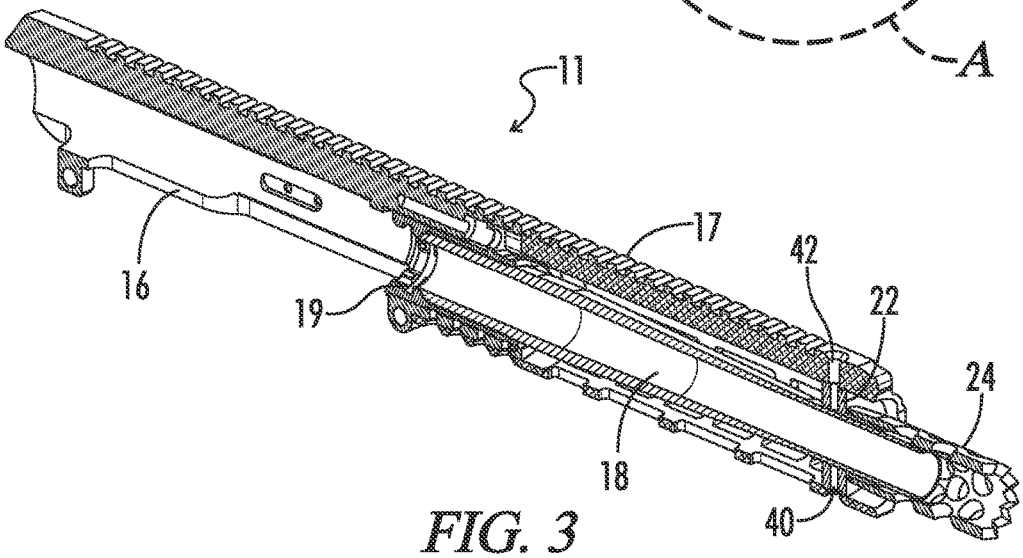
FIG. 3 a cutaway view of the partial firearm of FIG. 2 taken generally vertically along a longitudinal axis of the barrel.
Figure 4:
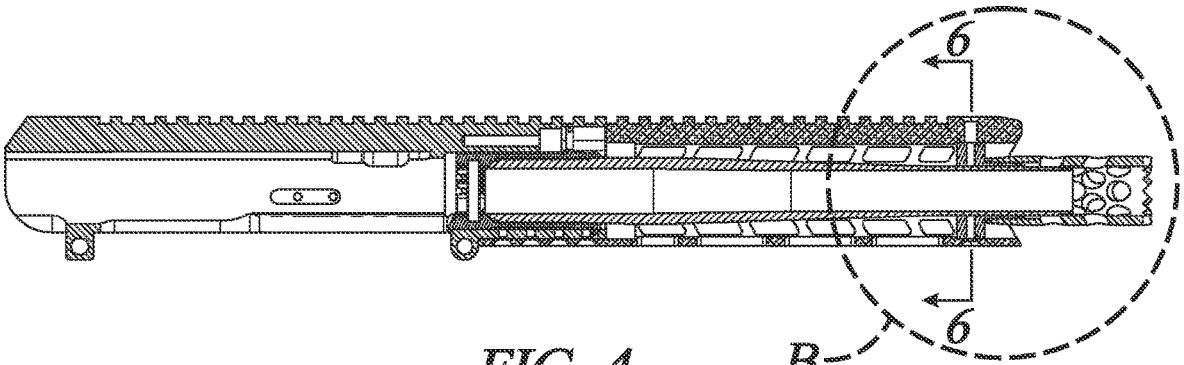
FIG. 4 is right side perspective cutaway view of the firearm of FIG. 3.

Referring to FIGS. 1-10, in one embodiment, a firearm 10 includes a buttstock 13, a receiver, a bolt 14, a handguard 17, and a barrel 18. The receiver of the firearm 10 may include an upper receiver 16 and a lower receiver 12. The firearm 10 may also include a magazine 15 and optics or sights, as well as other accessories. The barrel 18 extends along a longitudinal axis 34. The handguard 17 generally surrounds (e.g., except for cutouts, access holes, vents, etc.) the barrel 18 along a portion of the barrel 18. The handguard 17 shown herein is a skeletonized handguard with a Picatinny or Weaver rail system, but it is contemplated within the scope of the disclosure and claims that the handguard 17 includes other types of handguards 17 such as generally continuous cylindrical barrel shrouds and handguards including multiple or no rail systems and/or keymod holes. The firearm 10 of FIG. 1 is a prior art AR-platform shotgun incorporating a short recoil operating mechanism.

Referring now to FIGS. 2-10, the firearm 10 is modified with a muzzle device 20 according to one embodiment of the invention. In some embodiments, the muzzle device 20 includes a muzzle adapter 22 and a muzzle attachment 24. In one embodiment, the muzzle attachment 24 is integral with the muzzle adapter 22 (the muzzle attachment 24 is integrally formed with, welded to, or soldered to the muzzle adapter 22 such that the muzzle attachment is generally considered permanently attached to the muzzle adapter 22).

In one embodiment, the muzzle adapter 22 includes a base portion 26 and an extension portion 28. In one embodiment, the base portion 26 is annular or disk shaped and the extension portion 28 is tubular or conical. The base portion 26 is configured to attach to the handguard 17 and extend radially inward from the handguard 17 toward the longitudinal axis 34 and the barrel 18 of the firearm 10. The base portion 26 is configured to receive the barrel 18 of the firearm 10 therein. The base portion 26 is not attached to the barrel 18.

The extension portion 28 is attached to the base portion 26 and is supported by the base portion 26. The extension portion 28 is configured to receive and support the muzzle attachment 24. The extension portion 28 extends forward (i.e., longitudinally away from the buttstock 13) from a forward surface 30 of the base portion 26. The base portion 26 is closer to the butt stock 13 of the firearm 10 than the extension portion 28 when the muzzle adapter 22 is properly attached to the handguard 17 of the firearm 10 such that the extension portion 28 extends forward from the base portion 26 and the base portion 26 is rearward of the extension portion 28. In one embodiment, the extension portion 28 is integral with the base portion 26, and in another embodiment, the extension portion 28 threading engages the base portion 26.

The base portion 26 has a bore 32 extending therethrough that is centered about the longitudinal axis 34. The extension portion 28 also has a bore 32 extending therethrough. The bore 32 of the base portion 26 and the bore 32 of the extension portion 28 are in fluid communication with one another. The bore 32 through the extension portion 28 has a diameter at least as large as a diameter of the bore 32 through the base portion 26. In one embodiment, the board 32 through the extension portion 28 has a diameter greater than the diameter of the bore 32 at the base portion 26 such that the bore 32 through the muzzle adapter 22 flares outward toward a forward most surface 50 of the extension portion 28. The bore 32 is sized and shaped to receive the barrel 18 and allow the barrel to reciprocate therein during cycling of the firearm 10. The bore 32 of the muzzle adapter 22 is coaxial with the longitudinal axis 34 of the barrel 18 when the muzzle adapter 22 is secured (i.e., attached) within the handguard 17.

In one embodiment, the base portion 26 of the muzzle adapter 22 is sized so that an exterior circumferential surface 38 of the base portion 26 can be received inside a forward end of the handguard 17. The exterior surface 38 of the base portion 26 may be generally annular or disc shaped, but the exterior surface may also contain significant voids about the exterior to reduce weight or for the purposes. For example, base portion 26 may have a rear plan view relative to the longitudinal axis 34 that resembles a plus sign with a hole in the middle (i.e., the bore 32), a Mercedes Benz® logo with a hole in the middle (i.e., the bore 32), or a Maltese cross with a hole in the middle (i.e., the bore 32). In one embodiment, the exterior surface 38 is threaded and an inside surface of the handguard 17 has corresponding threads such that the base portion 26 can attach to the handguard 17 via screwing into the handguard 17. In other embodiments, the exterior surface 38 of the base portion 26 is not generally circular or arcuate, but is instead a plurality of flat surfaces (e.g. a plus sign with a bore 32 therethrough) configured to engage corresponding flat surfaces of the inside of the handguard 17.

In one embodiment, one or more threaded apertures 40 are defined in the exterior circumferential surface 38 of the base portion 26. The apertures 40 extend radially outward from a center of the base portion 26 (e.g., from the longitudinal axis 34 when installed in the handguard 17). The apertures 40 are positioned around the exterior circumferential surface 38 so as to align with corresponding counterbored (i.e., chamfered or beveled) access holes 42 through the handguard 17 when the muzzle adapter 22 is installed in or attached to the handguard 17. Threaded fasteners 44 are threaded into the apertures 40 of the base portion 26 through the access holes 42 in the handguard 17 when the muzzle adapter 26 is installed in the forward end of handguard 17 to releasably secure or attach the muzzle adapter 22 within the handguard 17. Although the muzzle device 20 is depicted in FIGS. 2-8 as being secured within the handguard 17 via one visible threaded fastener 44, it is to be understood that a plurality of threaded fasteners 44 are receivable in each of a plurality of threaded apertures 40 through each of a plurality of access holes 42 (which are not visible in any single view of the muzzle device 20). Heads of the fasteners 44 are received into the chamfer or bevel in the access holes 42 such that the fasteners 44 are countersunk into the access holes 42.

Figure 5:
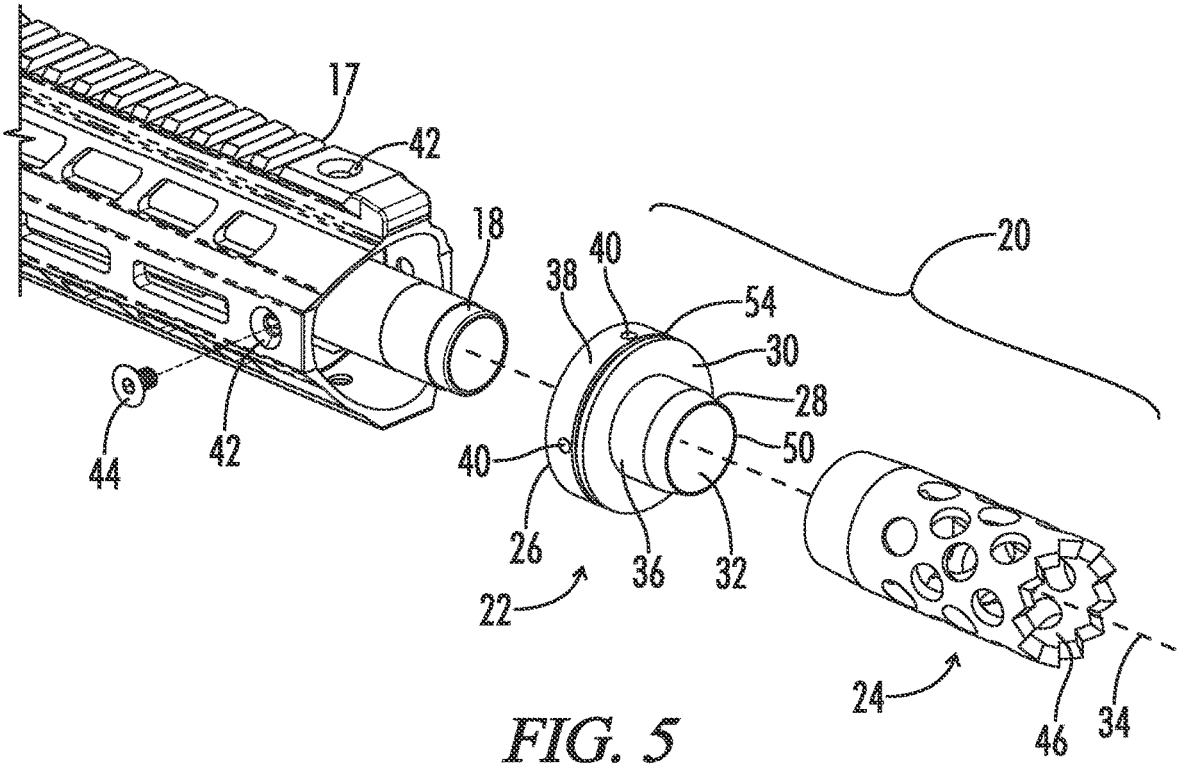
FIG. 5 is a partially exploded isometric view of the firearm of FIG. 2 at location A.
Figure 6:
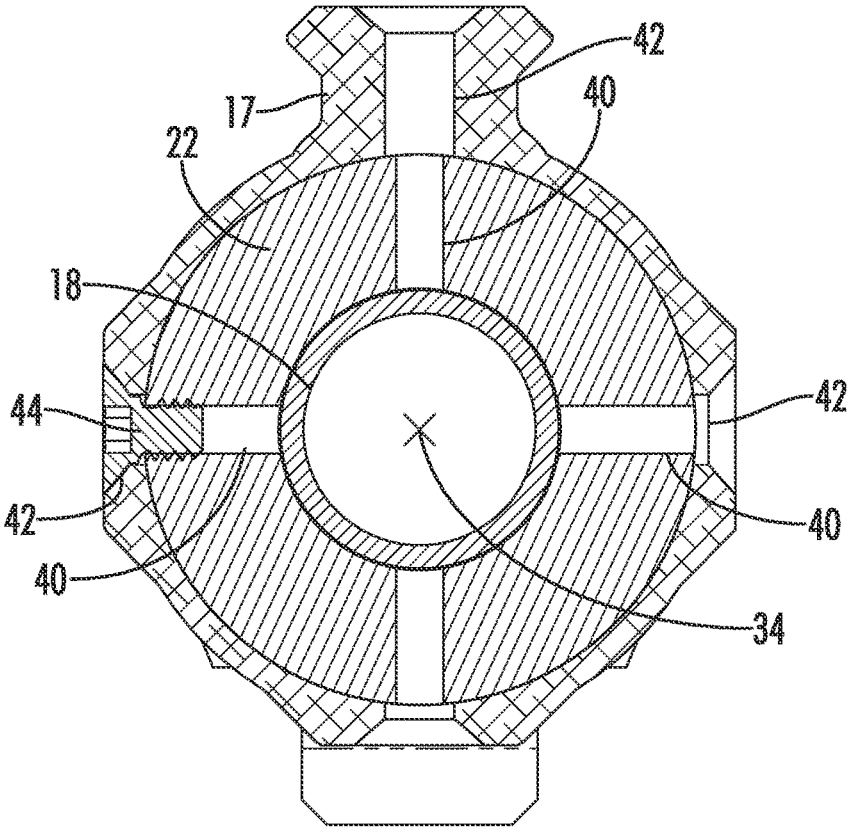
FIG. 6 is a cross sectional view of the firearm of FIG. 2 taken along line 6-6 (i.e., perpendicular to the longitudinal axis at an attachment point of the muzzle adapter to the handguard).

In one embodiment, the extension portion 28 of the muzzle adapter 22 is tapered from a point forward of the forward surface 30 of the base portion 2 to the forward surface 50 of the extension portion 28. More particularly, at least a portion of the extension portion is tapered forward of the forward surface 30 of the base portion 26 to facilitate engagement with the muzzle attachment 24 (i.e., insertion into the muzzle attachment 24). In one embodiment, an exterior circumferential surface 36 of the extension portion 28 is threaded. In one embodiment, the threaded portion of the exterior circumferential surface 26 of the extension portion 28 has a larger diameter than at the forwardmost surface 50 of the extension portion 28 such that the extension portion has a smaller cross sectional diameter relative to the longitudinal axis 34 at the forward surface 50 of the extension portion than at the threaded portion of the external circumferential surface 36 and/or at the forward surface 30 of the base portion 26. The extension portion 28 has an exterior diameter less than that of the base portion 26 such that a forward surface 30 of the base portion 26 extends radially outward from a rear end of the extension portion 28 like a flange, as best shown in FIG. 5. In one embodiment, the muzzle attachment 24 is a generally tubular member having a bore 46 extending longitudinally therethrough. A rear portion of the interior circumferential surface 48 of the muzzle attachment bore 46 is threaded complimentary to the threads on the exterior circumferential surface 36 of the extension portion 28 such that the muzzle attachment 24 can be releasably secured to the muzzle adapter 22. The bore 46 of the muzzle attachment 24 is coaxial with the axis 34 of the barrel 18 when the muzzle attachment 24 is secured to the muzzle adapter 22 and the muzzle adapter 22 is secured within the handguard 17. In one embodiment, a plurality of ports 47 are defined through the sides of the muzzle attachment 24. In one embodiment, a front end of the muzzle attachment defines a plurality of teeth 49 for maintaining the firearm 10 in a predetermined position against an object such as a door during use. In another embodiment, the muzzle attachment 24 is generally cylindrical with a plurality of baffles and/or internal chambers inside the cylinder adjacent the bore 46 such that the muzzle attachment 24 provides a noise suppresser function. Regardless of the configuration of the muzzle attachment 24 (e.g., a suppresser and/or a breacher tip with teeth 49) pressing the muzzle attachment 24 into an object (e.g., a door, hinge, or enemy) will not cause rearward longitudinal movement of the barrel 18 which would cause the firearm 10 to be in an out of battery (i.e., non-dischargeable) condition because the muzzle attachment 24, muzzle adapter 22, handguard 17, receiver 12, 16, and buttstock 13 are all fixed longitudinally with respect to one another when the firearm 10 is assembled. Thus, a recoil operated firearm 10 can be discharged (and fully cycled) with the muzzle attachment 24 pressed into an object.

Figure 7:
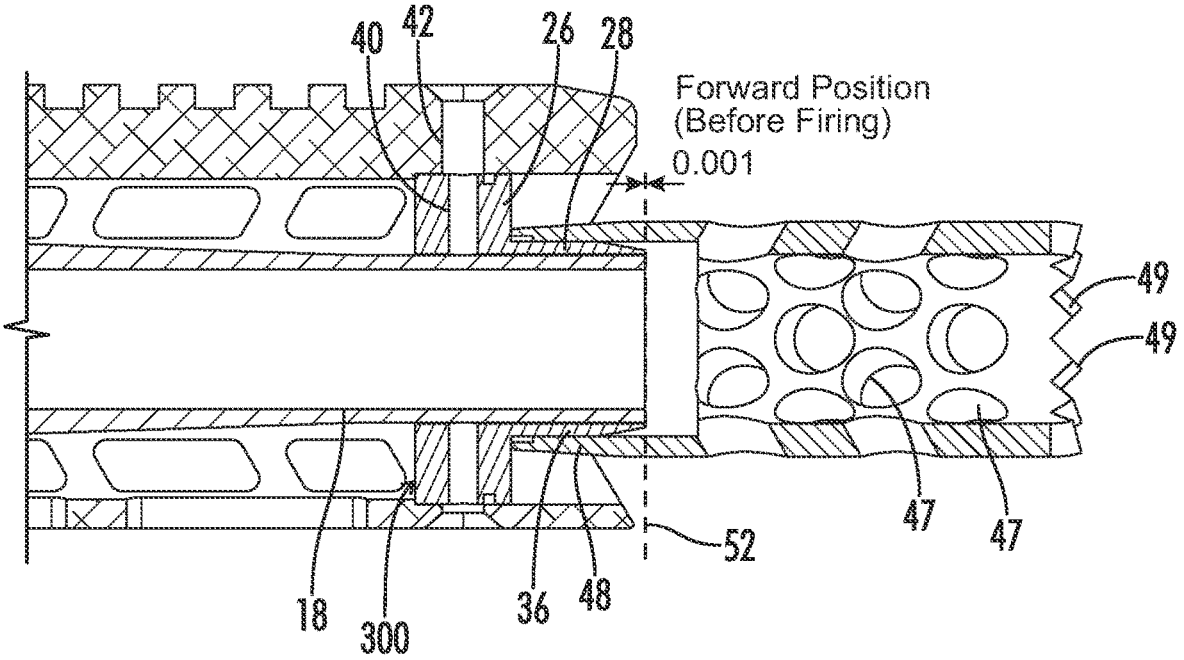
FIG. 7 is a side cut away view of the firearm of FIG. 2 at location B showing the barrel in a forward position before the firearm is fired.
Figure 8:
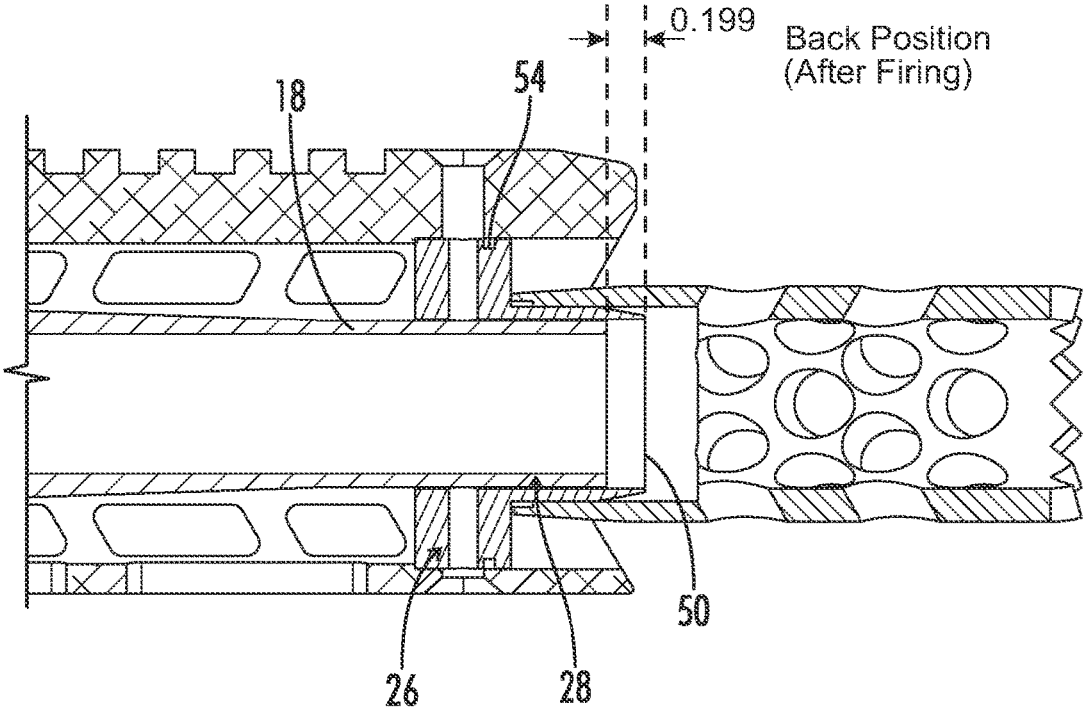
FIG. 8 is a side cut away view of the firearm of FIG. 2 at location B showing the barrel in a rearward position as the firearm is cycled upon discharge.

The extension portion 28 of the muzzle adapter 22 has a length and a forwardmost surface 50 defining a plane 52 perpendicular to the longitudinal axis 34. Referring now to FIGS. 7-8, in some embodiments, the length of the extension portion 28 is such that the tip of the barrel 18 does not extend longitudinally beyond the forwardmost surface 50 when the barrel 18 is in the forward, in-battery position prior to firing. This prevents the barrel 18 from contacting the muzzle attachment 24 or occluding ports 47 defined in the muzzle attachment 24 during use. As best shown in FIG. 7, the tip of the barrel 18 can be slightly set back or recessed a first distance from the forwardmost surface 50 of the muzzle adapter 22 when the barrel 18 is in the forward in-battery position (e.g., ready to discharge). In one embodiment, the first distance (i.e., the distance the muzzle of the barrel 18 is longitudinally rearward of the forwardmost surface 50 of the muzzle adapter 22) is approximately 0.001 inches. As best shown in FIG. 8, after firing, the tip (i.e., muzzle) of the barrel 18 can move longitudinally rearward upon discharge (i.e., during cycling) to a rear position a second distance from the plane 52. In one embodiment, the second distance is approximately 0.199 inches. In other embodiments, the tip of the barrel 18 can extend beyond plane 52. Because the muzzle adapter 22 is positioned and secured within the handguard 17 around the barrel 18, and the muzzle attachment 24 is threaded onto the extension portion 28 of the adapter 22 as shown and described, the barrel 18 never contacts the muzzle adapter 22 or the muzzle attachment 24 during use and cycling of the firearm 10, even when the barrel is fully forward in the in-battery position. Consequently, the barrel 18 can safely reciprocate without interference and without having to move the weight of the muzzle attachment 24, which can slow or prevent cycling. In one embodiment, the end of the barrel 18 (i.e., muzzle) remains longitudinally between the forward surface 50 (i.e., forwardmost surface 50) of the extension portion 28 and a rear surface 300 of the base portion 26 as the barrel 18 reciprocates during discharge and cycling of the firearm 10 (i.e., at all times while the muzzle adapter 22 is installed on the firearm 10).

Figure 9:
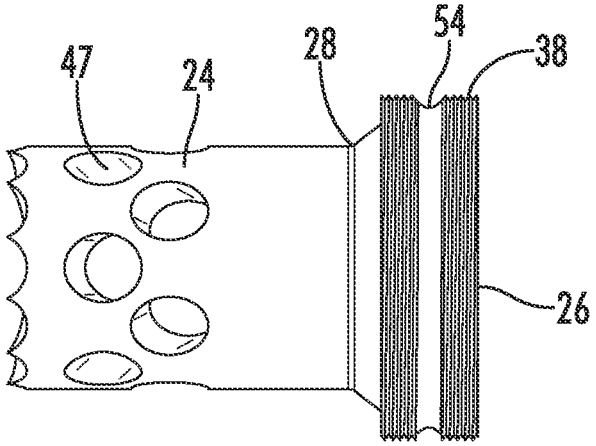
FIG. 9 is a side perspective view of a muzzle adapter according to one embodiment of the invention.
Figure 10:
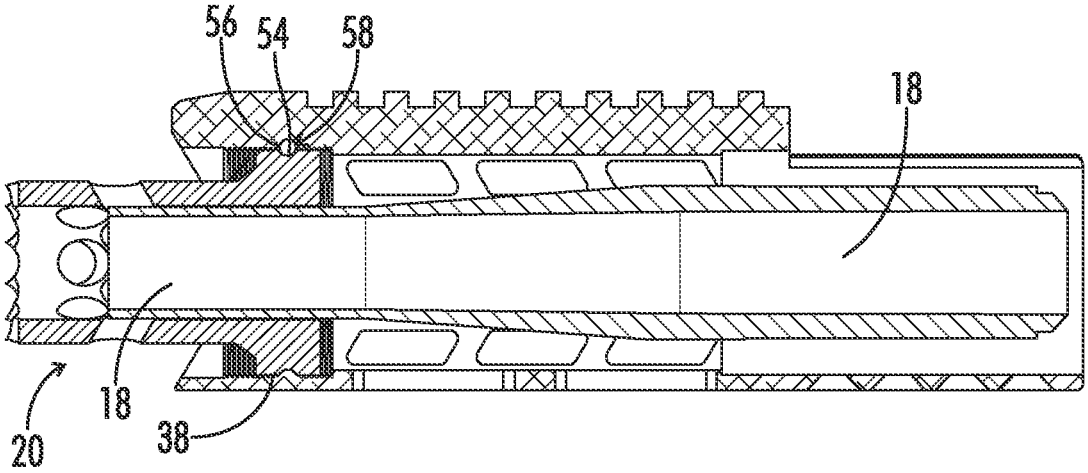
FIG. 10 is a left side cut away view of the muzzle adapter of FIG. 9 properly installed in a handguard.

Referring now to FIGS. 9-10, in one embodiment, the muzzle attachment 24 is integral with the extension portion 28 of the muzzle adapter 22. In one embodiment, the muzzle adapter 22 includes an annular channel 54 or groove 54 defined in the exterior surface 38 of the base portion 26. The handguard 17 has a through hole 56 or pair of corresponding holes. A pin 58 is receivable in the through hole 56 when muzzle adapter 22 is received in the handguard 17 and the channel 54 is longitudinally aligned with the through hole 56 to lock the muzzle adapter 22 in the handguard 17. The pin 58 may be held in place by friction fit, threads, detent, adhesives, or any other method known in the art. The pin 58 concurrently contacts the groove 54 and handguard 17 hole 56 to eliminate longitudinal movement of the muzzle adapter 22 relative to the handguard 17 and attach or secure the muzzle adapter 22 to the handguard 17. Although one pin 58 and hole 56 are shown, it should be understood by one of ordinary skill in the art that multiple pins may be preferred (e.g., one at the top and one at the bottom) to secure the muzzle adapter 22 to the handguard 17. Additionally, attachment mechanisms discloses herein (e.g., pin 58 and groove 54, holes 40, 42 with fasteners 44, and a threaded exterior circumferential surface 38 in combination with internal threading in the handguard 17) may be used in combination to secure the muzzle adapter 22 to the handguard 17.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Thus, although there have been described particular embodiments of the present invention of a new and useful MUZZLE DEVICE FOR A FIREARM it is not intended that such references be construed as limitations upon the scope of this invention except as set forth in the following claims

What is claimed is:

1. A muzzle device for a firearm, said muzzle device comprising:

a muzzle adapter comprising:

a base portion configured to attach to a handguard of the firearm and extend radially inward toward a longitudinal axis and a barrel of the firearm, wherein said base portion is configured to receive the barrel of the firearm and allow the barrel to reciprocate therein during cycling of the firearm; and an extension portion attached to the base portion and supported by the base portion, wherein the extension portion is configured to receive a muzzle attachment and the base portion is closer to a buttstock of the firearm than the extension portion when the muzzle adapter is properly attached to the handguard of the firearm such that the extension portion extends forward from the base portion and the base portion is rearward of the extension portion.

2. The muzzle device of claim 1, wherein:

the base portion has a bore therethrough centered around the longitudinal axis;

the extension portion has a bore therethrough centered around the longitudinal axis; and the bore of the extension portion is in fluid communication with the bore of the base portion.

3. The muzzle device of claim 1, wherein:

the base portion is not attached to the barrel.

4. The muzzle device of claim 1, wherein:

the firearm is a recoil operation firearm such that the barrel reciprocates along the longitudinal axis during cycling;

the muzzle adapter has a rear surface of the base portion and a forward surface of the extension portion;

the barrel remains longitudinally between the rear surface of the base portion and the forward surface of the extension portion as the barrel reciprocates during cycling of the firearm.

5. The muzzle device of claim 1, wherein:

at least a portion of the extension portion is tapered from a forward surface of the base portion to a forward surface of the extension portion such that the extension portion has a smaller cross sectional diameter relative to the longitudinal axis at the forward surface of the extension portion than at the forward surface of the base portion.

6. The muzzle device of claim 1, wherein:

the extension portion comprises an external circumferential surface that is threaded;

the extension portion is tapered from the eternal circumferential surface to a forward surface of the extension portion such that the extension portion has a smaller cross sectional diameter relative to the longitudinal axis at the forward surface of the extension portion than at the external circumferential surface.

7. The muzzle device of claim 1, wherein:
the muzzle device further comprises the muzzle attachment; and
the muzzle attachment is integral with the extension portion of the muzzle adapter.

8. The muzzle device of claim 1, wherein:
the muzzle adapter further comprises at least one pin;
the base portion of the muzzle adapter comprises a groove in an exterior surface of the base portion; and
the muzzle adapter is attached to the handguard by inserting the pin through a hole in the handguard such that the pin concurrently engages the handguard at the hole and the base portion at the groove to attach the muzzle adapter to the handguard and prevent longitudinal movement of the muzzle adapter relative to the handguard.

9. The muzzle device of claim 1, wherein:
the base portion comprises a threaded exterior surface configured to engage corresponding threads on an inside surface of the handguard to attach to the muzzle attachment to the handguard.

10. The muzzle device of claim 1, wherein:
the muzzle adapter further comprises a plurality of fasteners;
the handguard has a plurality of holes therethrough;
the base portion comprises a plurality of apertures in an exterior surface thereof, and the muzzle adapter is configured to attach to the handguard by installing the plurality of fasteners into the apertures in the exterior surface of the base portion through the plurality of holes through the handguard such that the plurality of fasteners concurrently engage a hole of the plurality of holes through the handguard and a corresponding aperture in the exterior surface of the base portion of the muzzle adapter;
the plurality of fasteners are threaded fasteners;
the apertures in the exterior surface of the base portion have threads corresponding to the threads of the plurality of fasteners;
installing the plurality of fasteners into the holes in the exterior surface of the base portion comprises screwing the plurality of fasteners into the holes in the exterior surface of the base portion; and
each hole through the handguard is chamfered or beveled such that a head of a fastener of the plurality of fasteners is received into the chamfer or bevel when the fastener is installed into a hole of the plurality of holes through said hole in the handguard, countersinking the head of the fastener into said hole in the handguard.

11. A firearm comprising:
a barrel extending along a longitudinal axis;
a handguard generally surrounding the barrel along a portion of the barrel;
a muzzle device comprising:
a muzzle adapter comprising:
a base portion configured to attach to the handguard and extend radially inward toward the longitudinal axis and barrel of the firearm, wherein said base portion is configured to receive the barrel of the firearm and allow the barrel to reciprocate therein during cycling of the firearm; and
an extension portion attached to the base portion and supported by the base portion, wherein the extension portion is configured to receive a muzzle attachment and the base portion is closer to a buttstock of the firearm than the extension portion when the muzzle adapter is properly attached to the handguard of the firearm such that the extension portion extends forward from the base portion and the base portion is rearward of the extension portion.

12. The firearm of claim 11, wherein:
the base portion has a bore therethrough centered around the longitudinal axis;
the extension portion has a bore therethrough centered around the longitudinal axis;
the bore of the extension portion is in fluid communication with the bore of the base portion; and
the bore through the extension portion has a diameter at least as large as a diameter of the bore through the base portion.

13. The firearm of claim 11, wherein:
the base portion is not attached to the barrel.

14. The firearm of claim 11, wherein:
the firearm is a recoil operation firearm such that the barrel reciprocates along the longitudinal axis during cycling;
the muzzle adapter base portion has a rear surface and the extension portion has a forward surface;
the barrel remains longitudinally between the rear surface of the base portion and the forward surface of the extension portion as the barrel reciprocates during cycling of the firearm.

15. The firearm of claim 11, wherein:
a least a portion of the extension portion is tapered from a forward surface of the base portion to a forward surface of the extension portion such that the extension portion has a smaller cross sectional diameter relative to the longitudinal axis at the forward surface of the extension portion than at the forward surface of the base portion.

16. The firearm of claim 11, wherein:
the extension portion comprises an external circumferential surface that is threaded;
the extension portion is tapered from the eternal circumferential surface to a forward surface of the extension portion such that the extension portion has a smaller cross sectional diameter relative to the longitudinal axis at the forward surface of the extension portion than at the external circumferential surface.

17. The firearm of claim 11, wherein:
the firearm further comprises a muzzle attachment; and
the muzzle attachment is integral with the extension portion of the muzzle adapter.

18. The firearm of claim 11, wherein:
the muzzle adapter further comprises at least one pin;
the base portion of the muzzle adapter comprises a groove in an exterior surface of the base portion; and
the muzzle adapter is attached to the handguard by inserting the pin through a hole in the handguard such that the pin concurrently engages the handguard at the hole and the base portion at the groove to attach the muzzle adapter to the handguard and prevent longitudinal movement of the muzzle adapter relative to the handguard.

19. The firearm of claim 11, wherein:
the base portion comprises a threaded exterior surface configured to engage corresponding threads on an inside surface of the handguard to attach to the muzzle attachment to the handguard.

20. The firearm of claim 11, wherein:
the muzzle adapter further comprises a plurality of fasteners;
the handguard has a plurality of holes therethrough;

the base portion comprises a plurality of apertures in an exterior surface thereof, and the muzzle adapter is configured to attach to the handguard by installing the plurality of fasteners into the apertures in the exterior surface of the base portion through the plurality of holes through the handguard such that the plurality of fasteners concurrently engage a hole of the plurality of holes through the handguard and a corresponding aperture in the exterior surface of the base portion of the muzzle adapter;

the plurality of fasteners are threaded fasteners;

the apertures in the exterior surface of the base portion have threads corresponding to the threads of the plurality of fasteners;

installing the plurality of fasteners into the holes in the exterior surface of the base portion comprises screwing the plurality of fasteners into the holes in the exterior surface of the base portion; and each hole through the handguard is chamfered or beveled such that a head of a fastener of the plurality of fasteners is received into the chamfer or bevel when the fastener is installed into a hole of the plurality of holes through said hole in the handguard, countersinking the head of the fastener into said hole in the handguard.

* * * * *